US005237948A

United States Patent [19]

Hvide

[11] Patent Number: 5,237,948

[45] Date of Patent: Aug. 24, 1993

[54] MOORING SYSTEM FOR OIL TANKER STORAGE VESSEL OR THE LIKE

[75] Inventor: Hans J. Hvide, Jalan Jelita, Singapore

[73] Assignee: Nortrans Shipping and Trading Far East Pte Ltd., Singapore

[21] Appl. No.: 896,362

[22] Filed: Jun. 10, 1992

[51] Int. Cl.[5] ..... B63B 21/00

[52] U.S. Cl. ..... 114/230

[58] Field of Search ..... 441/3-5; 114/230; 166/352, 354, 355

[56] References Cited

U.S. PATENT DOCUMENTS

| | | | |
|---|---|---|---|
| 3,535,883 | 10/1970 | Manning | 114/230 |
| 3,614,869 | 10/1971 | Flory et al. | 114/230 |
| 3,700,014 | 10/1972 | Scales et al. | 114/230 |
| 4,031,582 | 6/1977 | Van Heijst | 114/230 |
| 4,042,990 | 8/1977 | Donaldson, Jr. | 114/230 |
| 4,069,529 | 1/1978 | Van Heijst | 114/230 |
| 4,138,751 | 2/1979 | Kentosh | 441/5 |
| 4,280,238 | 7/1981 | Van Heijst | 114/230 |
| 4,320,545 | 3/1982 | Pomonik | 114/230 |
| 4,326,312 | 4/1982 | Tang | 114/230 |
| 4,459,930 | 7/1984 | Flory | 114/230 |
| 4,546,721 | 10/1985 | Langrock | 114/230 |
| 4,602,586 | 7/1986 | Ortloff | 114/230 |
| 4,606,727 | 8/1986 | Koenig et al. | 441/5 |
| 4,637,335 | 1/1987 | Pollack | 114/230 |
| 4,637,336 | 1/1987 | Engelskirchen | 114/230 |
| 4,650,431 | 3/1987 | Kentosh | 114/230 |
| 4,654,015 | 3/1987 | Kentosh | 114/230 |
| 4,721,053 | 1/1988 | Brewerton | 114/230 |
| 4,765,378 | 8/1988 | Engelskirchen et al. | 114/230 |
| 4,798,155 | 1/1989 | Poldervaart | 114/230 |
| 4,802,431 | 2/1989 | Pollack | 114/230 |
| 4,838,823 | 6/1989 | De Baan et al. | 114/230 |
| 4,841,895 | 6/1989 | Brewerton | 114/230 |
| 4,892,495 | 1/1990 | Svensen | 114/230 |
| 4,917,038 | 4/1990 | Poldervaart et al. | 114/230 |
| 4,955,310 | 9/1990 | Pollack | 114/230 |
| 5,025,742 | 6/1991 | Urdshals | 114/230 |
| 5,041,038 | 8/1991 | Poldervaart et al. | 114/230 |
| 5,052,322 | 10/1991 | Poldervaart et al. | 114/230 |

FOREIGN PATENT DOCUMENTS

| | | | |
|---|---|---|---|
| 2150517 | 7/1985 | United Kingdom | 441/5 |

*Primary Examiner*—Edwin L. Swinehart
*Attorney, Agent, or Firm*—Jones, Tullar & Cooper

[57] ABSTRACT

A mooring system for an oceangoing vessel such as an oil tanker is disclosed. The system includes a rigid shaft immovably affixed to said vessel, a collar attached to the lower end of the shaft and a chain table rotatably mounted on the collar. The system is easily repaired and maintained and provides a stable solid anchoring arrangement which is able to withstand the intense stress to which it is subjected when mooring a vessel in rough, ocean waters.

11 Claims, 4 Drawing Sheets

MOORING SYSTEM FOR OIL TANKER STORAGE VESSEL OR THE LIKE

BACKGROUND OF THE INVENTION

1. Field of the Invention

The present invention is directed to a mooring system for floating structures. More particularly, the present invention is directed to a mooring system for oil tankers, oil storage vessels or similar structures useful in offshore oil drilling and production facilities.

2. Description of the Prior Art

Crude oil and related refined petroleum products have been in the past and continue to be the primary source of fuel for heating, transportation and other utilities throughout the world. The need for continuing and expanded oil production has spawned a significant increase in the number of floating offshore storage and floating offshore production and storage facilities.

Oceangoing vessels such as tankers are of obvious use in offshore hydrocarbon production and storage activity. These vessels include fluid transportation means such as a transfer hose or piping which connects the vessel to the sea bed or the shore or another vessel and through which oil is transported to and from the vessel.

In transferring oil through the fluid transportation means, it is necessary to stably anchor the vessel to the ocean floor to prohibit excessive movement in rough ocean waters. Anchoring or mooring systems often further include a provision for supporting the flexible hose or pipe. It is therefore necessary that the mooring system exhibit high degrees of both strength and resiliency in providing a stable, immovable anchor for the vessel which withstands intense stress from the inevitable oscillatory and swaying motions imparted to the floating vessel by the ocean.

Heretofore, various underwater structural arrangements have been utilized for mooring floating structures such as oil tankers. For example, U.S. Pat. No. 4,637,336 to Engelskirchen discloses an anchoring arrangement which includes an underwater chamber which is suspended under the tanker and which is surrounded by a revolving platform from which anchoring chains are radially outwardly suspended. Such suspended arrangements have a number of inherent disadvantages. First, suspended arrangements are movably attached to the floating structure at various points by flexible mooring lines. This flexible attachment arrangement may fail under the intense stress of ocean use and provides a limited degree of mooring stability. Further, the majority of all of the cooperating parts of such suspended arrangements are typically below the water line when in use and therefore may be subjected to and damaged by the ocean water. Also, suspended systems typically require costly attention by a diver or team of divers to perform maintenance and repair work.

A strong need therefore exists for a mooring system which has a high degree of strength and support and which is easily maintained and repaired.

SUMMARY OF THE INVENTION

It is therefore an object of the present invention to provide a mooring system which is easily and simply repaired and maintained.

It is a further object of the present invention to provide a mooring system which stably and solidly anchors an oceangoing vessel to the ocean floor.

It is yet a further object of the present invention to provide a mooring system which withstands the intense stress to which it is subjected when mooring a vessel in rough ocean waters.

These and other objects are achieved by the present invention through its believed novel combination of structural elements, including a rigid shaft immovably and directly connected to the lower structure of a vessel to be moored, a collar attached to the shaft at its lower end and a chain table rotatably mounted on said collar. In a first preferred embodiment, the rigid shaft is hollow and extends through the thickness of the bow of the vessel and a rigid pipe extends through the center of the chain table and rigid shaft. In a second preferred embodiment the rigid shaft is hollow and is immovably attached to the hull of the vessel.

BRIEF DESCRIPTION OF THE DRAWINGS

The foregoing and other objects, features and advantages of the present invention are apparent from the detailed description set forth below taken in conjunction with the accompanying drawings in which.

DETAILED DESCRIPTION OF THE PREFERRED EMBODIMENT

Figure 1:
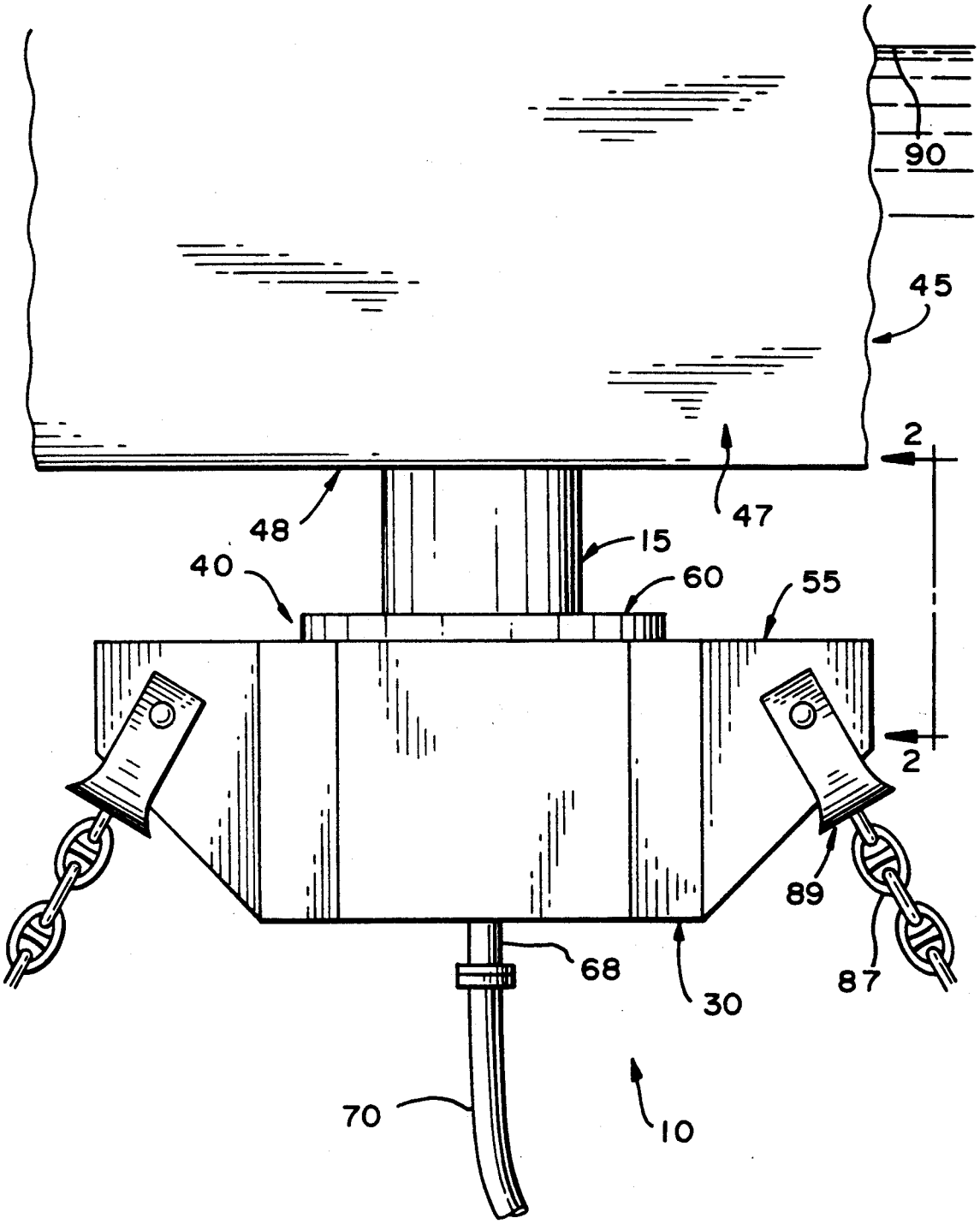
FIG. 1 is a side elevational view of a vessel including a first preferred embodiment of the mooring system of the present invention.

As shown in FIGS. 1 through 4, the mooring system 10 of the present invention, in its broadest sense, includes a rigid shaft 15 having an upper end 17 and a lower end 19, a chain table 30 rotatably mounted on the shaft 15 and a means 40 for rotatably mounting the chain table 30 on the collar 20. The upper end 17 of rigid shaft 15 is immovably and directly connected to a vessel 45 by suitable means such as bolting, welding, clamping or the like.

Figure 2:
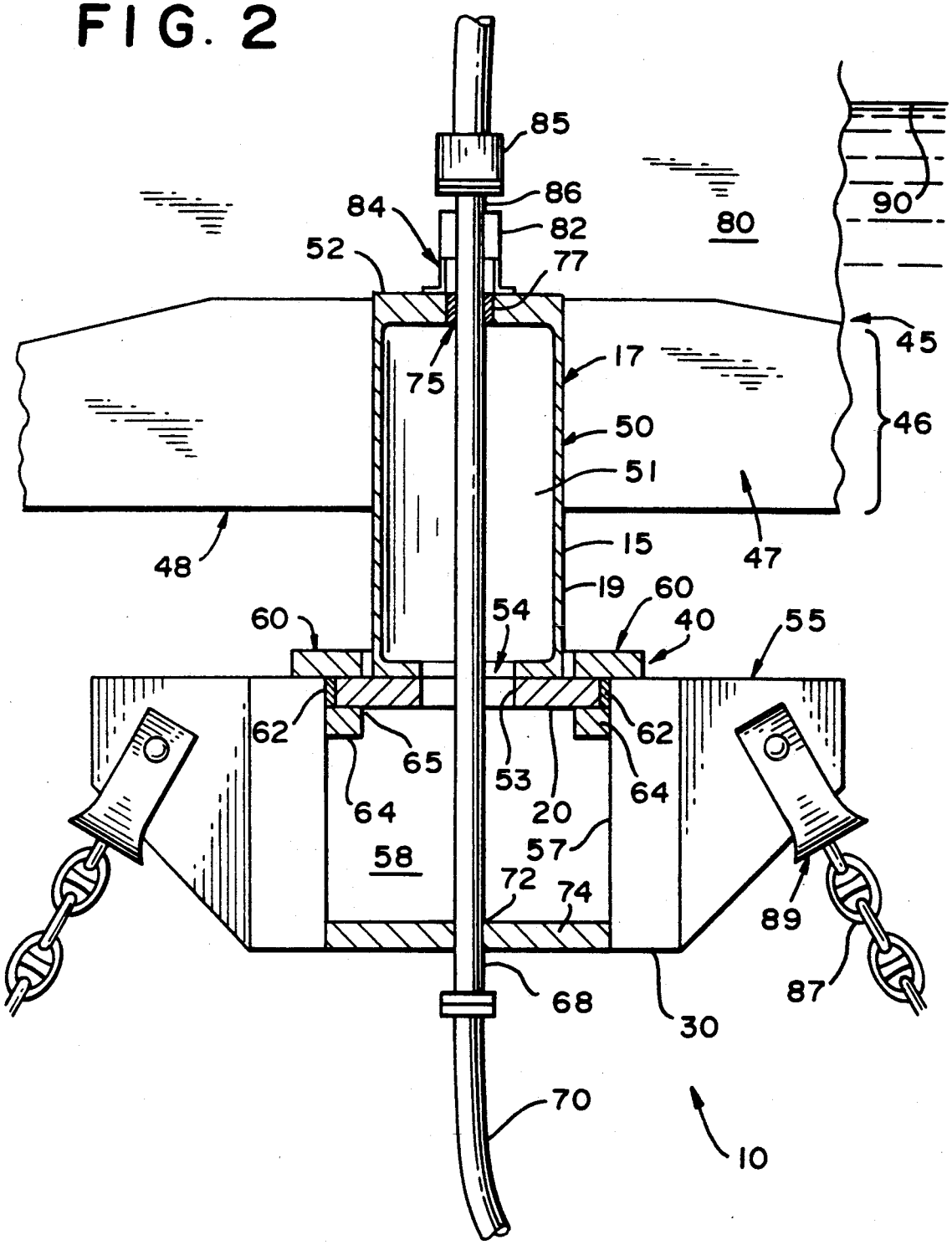
FIG. 2 is a side elevational view of a vessel including a first preferred embodiment of the mooring system of the present invention with a partial cross-section taken along line 2—2 of FIG. 1.

In a first preferred embodiment of the present invention best shown in FIGS. 1 and 2, rigid shaft 15 extends through a thickness 46 of a hull 47 of the vessel 45, and may optionally extend substantially into the interior 80 of the vessel 45. This arrangement provides the system of the present invention with maximum strength and support to withstand the stresses placed upon it when in use; however, it is to be understood that other attachment arrangements may be utilized so long as the shaft 15 is immovably attached to the vessel 45. Most preferably, shaft 15 is hollow and includes a wall 50 defining a passage 51, and a top 52.

Figure 3:
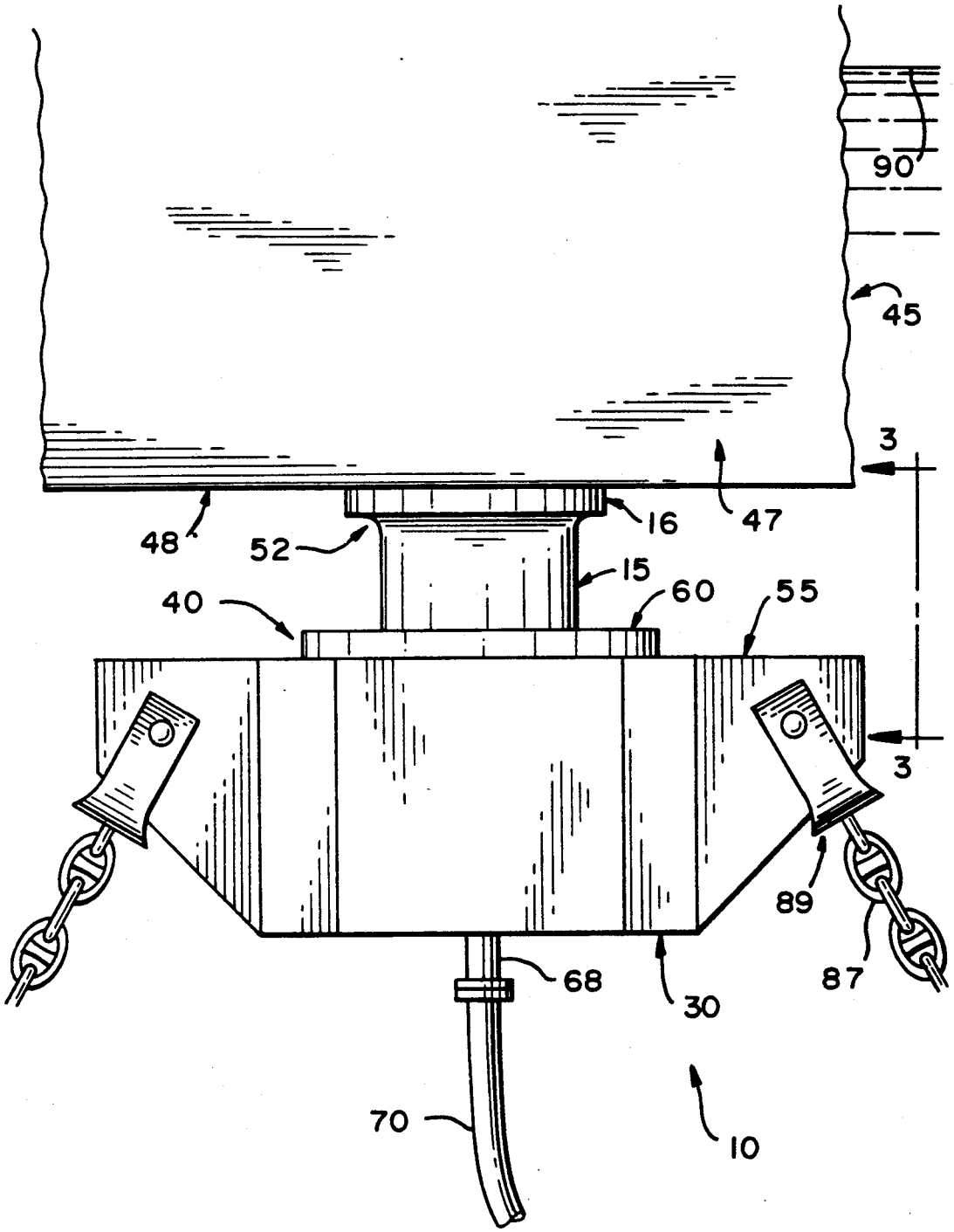
FIG. 3 is a side elevational view of a vessel including a second preferred embodiment of the mooring system of the present invention.
Figure 4:
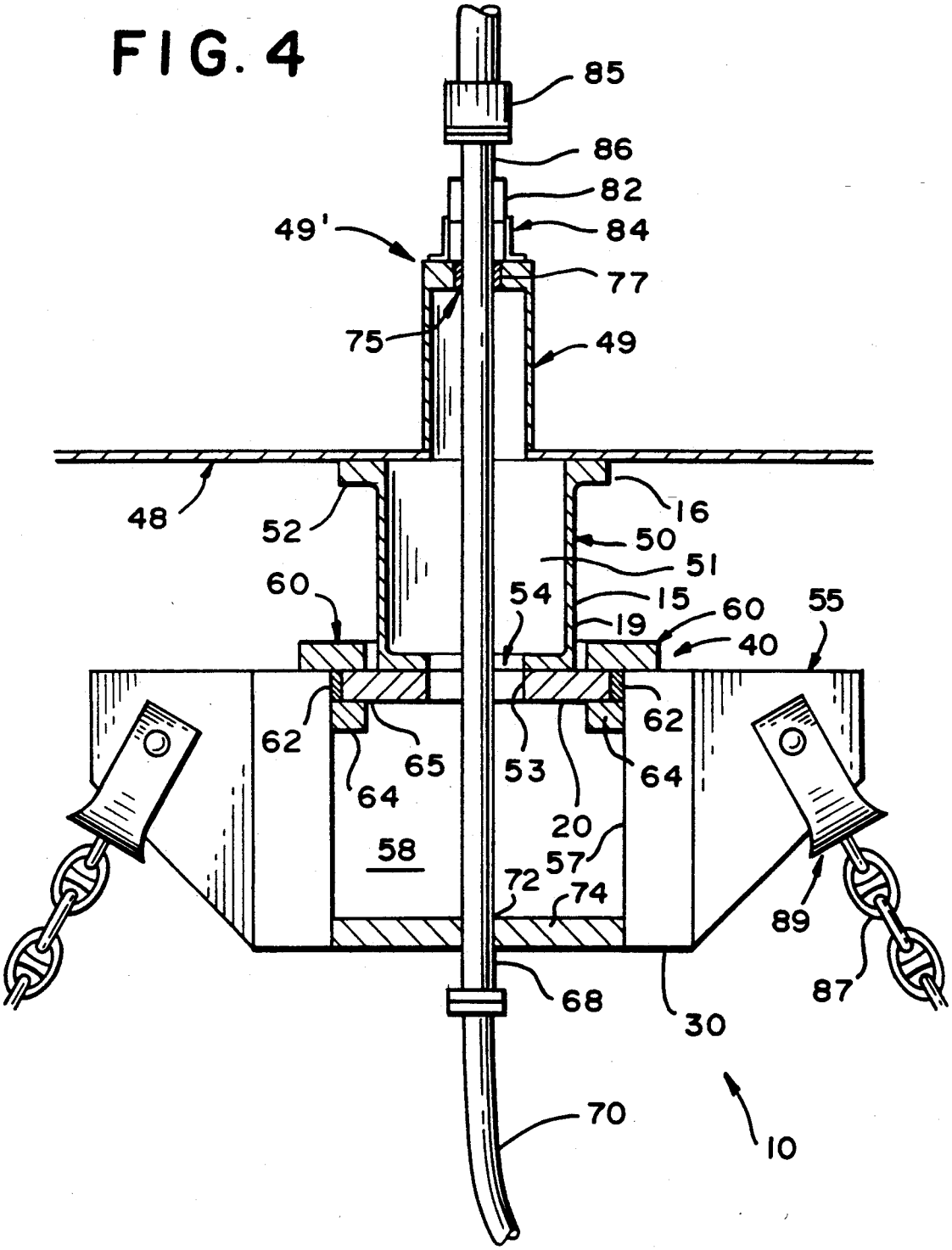
FIG. 4 is a side elevational view of a vessel including a second preferred embodiment of the mooring system of the present invention with a partial cross-section taken along line 3—3 of FIG. 3.

A second preferred embodiment of the present invention is best shown in FIGS. 3 and 4. In this second preferred embodiment, the shaft 15 includes a lip 16 at top 52 at which the shaft 15 is immovably attached to a base 48 of the hull 47 by welding, bolting, clamping or similar means. Base 48 further includes a hollow inwardly extending portion 49 which may extend into the interior 80 of the hull 47 a suitable distance, including zero.

Chain table 30 includes a top surface 55 and an inner surface 57 defining a core 58. Chain table 30 is rotatably mounted on shaft 15 by means 40 which preferably includes a collar 20 and a bearing means 40. Collar 20 preferably includes an inner edge 53 defining an aperture 54. Most preferably, collar 20 is rigidly attached to lower end 19 of shaft 15 by welding, bolting, clamping or similar means. Bearing means 40 preferably includes an upper thrust bearing 60 attached to the top surface 55 of chain table 30, a radial bearing 62 adjacent the upper thrust bearing 60 and a lower thrust bearing 64 attached to the inner surface 57 and adjacent the radial bearing 62. Upper thrust bearing 60 and lower thrust bearing 64 form a bearing slot 65 which receives collar 20. The upper thrust bearing, radial bearing and lower thrust bearing are preferably fitted with water or oil lubricated bearings.

The preferred mooring system of the present invention further includes a fluid transport means 68 for connection with a subsea fluid transport device such as a transfer hose 70 which extends from a fluid source or receiver (not shown). The means 68 is preferably a rigid pipe which extends through an aperture 72 formed in the bottom support 74 of the chain table 30, the core 58 of the chain table 30 and the passage 51 of the rigid shaft 15. In a first preferred embodiment, shown in FIGS. 1 and 2, the pipe 68 is rigid and extends through a bearing aperture 75 formed in the top 52 of the rigid shaft 15. The bearing aperture 75 further includes a locating bearing 77 fitted inside the aperture 75 to maintain the pipe 78 centrally within the shaft 15. In the second preferred embodiment, shown in FIGS. 3 and 4, bearing aperture 75 is formed in top 49, of inwardly extending portion 49 formed in the base 48 of hull 47. As in the first preferred embodiment, locating bearing 77 is fitted in aperture 75 to maintain the pipe 78 centrally within shaft 15.

The pipe 68 preferably extends into the interior 80 of the vessel 45 and may extend through the interior to above a vessel deck (not shown). A sealing means 82 may be included to prevent seawater from penetrating into the interior of the vessel. Sealing means 82 can be any suitable means, including packing seals, rubber lip seals, mechanical seals and the like.

In the first preferred embodiment shown in FIG. 2, sealing means 82 is attached to the top 52 of shaft 15 and locating bearing 77 by a flexible element 84 which permits slight movements of the pipe 15 within bearing 77. In the second preferred embodiment shown in FIGS. 3 and 4, sealing means 82 is attached to top 49' of hull portion 49 by flexible clement 84.

Fluid swivel 85 connects the pipe 68 to additional fluid transporting means and is located at the termination point 86 of the pipe 68. With this arrangement, fluid swivel 85 may be located within the vessel or above the deck of the vessel and is therefore not exposed to seawater.

FIGS. 1 through 4 further illustrate the mooring system of the present invention with attachments for application in its utilitarian environment. A plurality of mooring anchor chains 87 are attached to the chain table 30 by suitable chain stoppers 89 and extend from chain table 30 to the ocean floor (not shown). The chain stoppers 89 may be of the fixed or pivotable type, while the number of mooring anchor chains may be any number which is required to suitably moore the vessel.

In normal operation, the shaft 15 and chain table 30 of the mooring system of the present invention are located below the water line 90; however, the system may be brought clear of the water for repair and maintenance simply by deballasting the vessel.

Although the present invention has been disclosed in terms of a preferred embodiment, it is to be understood that numerous variations and modifications could be made thereto without departing from the true spirit and scope of the invention as set forth in the claims below. For example, the mooring system could be mounted to any portion of the vessel which may be desirable to suitably moor the vessel. Further, the present invention could be utilized to moor any type of vessel, including those not utilized in the transport of fluid material such as oil. When so utilized, the mooring system need not include any fluid transport piping or hose. Also, as discussed previously, any attachment arrangement may be utilized for connecting the shaft to the vessel so long as the connection is fixed, i.e. immovable.

What is claimed is:

1. A mooring system for an oceangoing vessel, said vessel including a hull having a thickness, said system comprising:

(a) a rigid shaft having an upper end and a lower end, said shaft being immovably fixed at said upper end to said vessel and said lower end of said shaft being disposed beneath and external of said hull; and (b) a chain table rotatably mounted on said lower end of said rigid shaft.

2. A system in accordance with claim 1 wherein said rigid shaft is hollow and includes a wall defining a passage, said chain table includes an inner surface defining a core, and said system further comprises fluid transport means extending through said core of said chain table and said passage of said shaft.

3. A system in accordance with claim 1 wherein said system further includes (1) a collar fixedly attached to said lower end of said shaft, and (2) bearing means disposed between said collar and said chain table.

4. A system in accordance with claim 3 wherein said chain table includes a top surface and an inner surface defining a core and said bearing means includes an upper thrust bearing attached to said top surface of said chain table and engaging a top surface of said collar, a lower thrust bearing attached to said inner surface of said chain table and engaging a bottom surface of said collar, and a radial bearing attached to said inner surface of said chain table between said upper and lower thrust bearings and engaging an edge surface of said collar.

5. A system in accordance with claim 1 wherein said rigid shaft extends substantially through said thickness of said hull.

6. A system in accordance with claim 1 wherein said upper end of said rigid shaft is immovably fixed to a base of said hull.

7. A system in accordance with claim 6 wherein said base further includes a hollow inwardly extending portion disposed above said rigid shaft.

8. A mooring system for an oceangoing vessel, said vessel including a hull having a thickness, said system comprising:

(a) a hollow, rigid shaft having an upper end and a lower end, said shaft including a wall defining a passage, said shaft immovably fixed to said vessel and extending through said thickness of said hull of said vessel at said upper end of said shaft and said lower end of said shaft being disposed beneath and external of said hull;

(b) a collar fixedly attached to said lower end of said shaft, said collar having an aperture disposed therein;

(c) a chain table rotatably mounted on said collar, said chain table including an inner surface defining a core;

(d) bearing means disposed between said chain table and said collar; and (e) a pipe extending through said core of said chain table, said aperture of said collar and said passage of said rigid shaft.

9. A mooring system for an oceangoing vessel, said vessel including a hull having a thickness, said system comprising:

(a) a hollow, rigid shaft having an upper end and a lower end, said shaft including a wall defining a passage, said upper end of said shaft being immovably fixed to a base of said hull and said lower end of said shaft being disposed beneath and external of said hull;

(b) a collar fixedly attached to said lower end of said shaft, said collar having an aperture disposed therein;

(c) a chain table rotatably mounted on said collar, said chain table including an inner surface defining a core;

(d) bearing means disposed between said chain table and said collar; and (e) a pipe extending through said core of said chain table, said aperture of said collar and said passage of said rigid shaft.

10. A system in accordance with claim 9 wherein said base further includes a hollow inwardly extending portion disposed above said rigid shaft.

11. A system in accordance with claim 9 wherein said bearing means includes:

i) an upper thrust bearing attached to a top surface of said chain table and engaging a top surface of said collar;

ii) a lower thrust bearing attached to said inner surface of said chain table and engaging a bottom surface of said collar; and iii) a radial bearing attached to said inner surface of said chain table between said upper and lower thrust bearings, and engaging an edge surface of said collar.

* * * * *